United States Patent [19]

Ubezio

[11] 4,343,094

[45] Aug. 10, 1982

[54] DRAFTING APPARATUS

[75] Inventor: Lorenzo Ubezio, Dietikon, Switzerland

[73] Assignee: Reppisch-Werke AG, Dietikon, Switzerland

[21] Appl. No.: 135,541

[22] Filed: Mar. 31, 1980

[30] Foreign Application Priority Data

Apr. 3, 1979 [CH] Switzerland ..... 3076/79

[51] Int. Cl.[3] ..... B43L 13/04; B43L 7/00; B43L 9/04

[52] U.S. Cl. ..... 33/430; 33/27 C; 33/158; 33/483

[58] Field of Search ..... 33/27 C, 430, 158, DIG. 1, 33/479, 483

[56] References Cited

U.S. PATENT DOCUMENTS

| | | | |
|---|---|---|---|
| 685,369 | 10/1901 | Barrie | 33/479 |
| 1,014,803 | 1/1912 | Bohn | 33/27 C |
| 3,589,013 | 6/1971 | Colon | 33/27 C |
| 4,051,599 | 10/1977 | Sinkovec | 33/27 C |

FOREIGN PATENT DOCUMENTS

| | | |
|---|---|---|
| 1206363 | 2/1960 | France . |
| 163580 | 8/1933 | Switzerland . |

*Primary Examiner*—Charles E. Phillips
*Attorney, Agent, or Firm*—W. G. Fasse; D. F. Gould

[57] ABSTRACT

The present drafting apparatus comprises a rail (6) removably secured along the edge of a drafting board. Normally, the rail (6) serves for guiding a T-square (2, 3) which is, for example, pulled against the rail (6) by a magnetic force. If the rail (6) is released from the brackets (8) it may be used together with the trammel heads (7) as a beam compass. For this purpose one of the trammel heads (7) is equipped with a compass needle tip (19) and the other trammel head is equipped with a compass drafting lead tip holder (16). A scale (21) attached to the rail (6) permits the precise adjustment of the radius. Further, the rail (6) when removed from the brackets (8) may also be used as a straight edge for drawing long, straight lines.

6 Claims, 7 Drawing Figures

DRAFTING APPARATUS

BACKGROUND OF THE INVENTION

The invention relates to a drafting apparatus having a drafting or drawing board equipped with a rail arranged along one longitudinal edge of the drafting board for supporting a displaceable T-square.

Numerous drafting devices are known in the art. However, conventional devices have the disadvantage that circular arcs having a large radius cannot be drawn with such conventional equipment.

OBJECTS OF THE INVENTION

In view of the above it is the aim of the invention to achieve the following objects singly or in combination:

to provide a drafting apparatus by means of which it is possible to draw circular arcs having a large radius without substantially increasing the cost;

to provide a component for a drafting system which serves for several purposes, such as a ruler, a beam compass, and a guide rail for a T-square; and to construct trammel heads in a simple and indentical way to receive different compass components such as a center pin or a lead holder.

SUMMARY OF THE INVENTION

According to the invention there is provided drafting equipment, including a drafting board and a rail arranged alongside one longitudinal edge of the drafting board normally used for supporting a T-square which is slidable back and forth along the rail which is secured to said longitudinal edge in a removable manner and which is equipped with components which transform the rail into a beam compass. These features make the rail which is normally used as a guide rail, versatile in its use because the trammel heads may remain on the rail also when it is used as a guide rail at which time the trammel heads operate as end stops. Merely the compass components are to be inserted into the trammel head when the rail is to be used as a beam compass for drawing circular curves of any desired radius within the dimensions of the drawing board. Additionally, the rail may be used as a long ruler when it is removed from the longitudinal edge of the drafting board. Thus, lines can be drawn substantially across the entire length of the drafting board because normally the guide rail has a length corresponding to the longitudinal edge of the drafting board.

BRIEF FIGURE DESCRIPTION

In order that the invention may be clearly understood, it will now be described, by way of example, with reference to the accompanying drawings, wherein.

Figure 1:
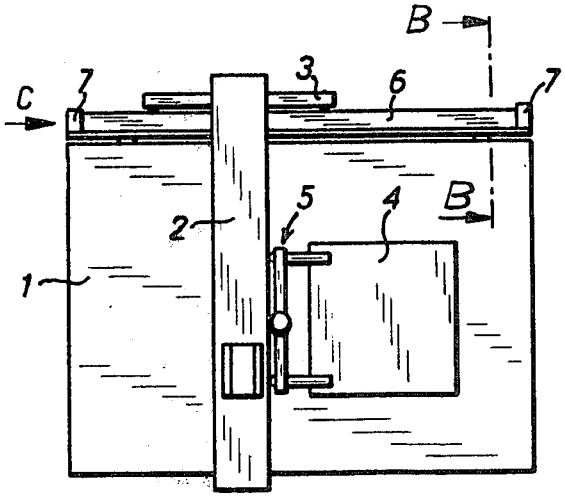
FIG. 1 is a top plan view of a drafting apparatus including a T-square equipped with a carriage supporting a ruler.
Figure 2:
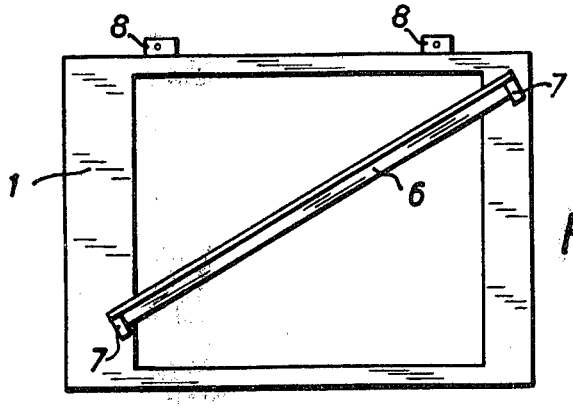
FIG. 2 is a top plan view onto the apparatus of FIG. 1 after the guide rail has been removed from the top longitudinal edge of the drawing board.

DETAILED DESCRIPTION OF PREFERRED EXAMPLE EMBODIMENTS AND OF THE BEST MODE OF THE INVENTION

The drafting apparatus comprises a drafting board 1. A guide rail 6 made of ferromagnetic metal is secured in a removable manner to the upper longitudinal edge of the drafting board 1. The guide rail 6 has an upper edge 10, please see FIG. 5, forming an abutment surface for a T-square comprising a T-square rail 2 and a headpiece or runner 3 which may rest on the abutment surface 10 for displacement along the guide rail. The runner 3 may either rest directly on the abutment surface 10 to slide along the surface or the runner may be equipped with rollers and magnets which pull the runner 3 toward the rail 6 whereby the rollers keep the magnets slightly spaced from the rail 6. A carriage 5 having attached thereto a ruler 4 is movable along the edge or edges of the T-square rail 2. The ruler 4 has preferably a square shape. The carriage 5 is preferably held against the T-square rail 2 by the force of magnet means. The carriage 5 is easily removed from the T-square rail 2 by overcoming the magnetic attraction force.

If desired, the carriage may also be attached to the opposite narrow edge of the T-square rail 2 if the latter is made entirely of ferromagnetic material or if both edges are equipped with ferromagnetic rods. The T-square may be constructed so that the T-square rail 2 is adjustable or tiltable through a relatively small angular range relative to the runner 3.

Figure 5:
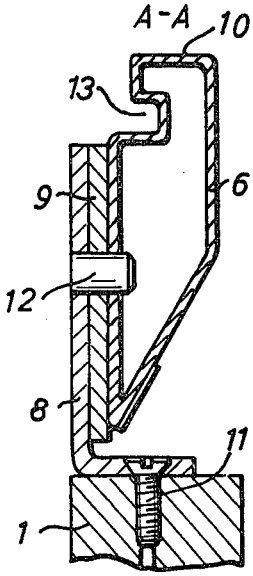
FIG. 5 is a sectional view along line A—A in FIG. 4.
Figure 6:
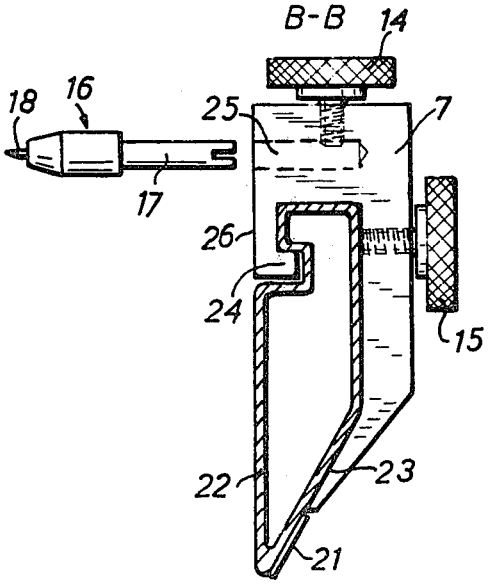
FIG. 6 is a sectional view along line B—B in FIG. 1.
Figure 7:
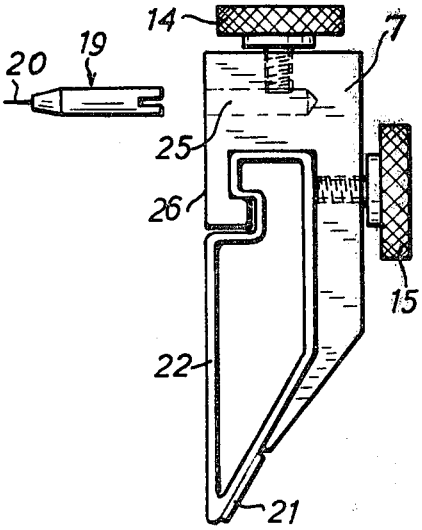
FIG. 7 is a sectional view against the end of the guide rail and one trammel head in the direction of the arrow C in FIG. 1.

The rail 6 is secured to the upper longitudinal edge of the drafting board 1 by means of magnet plates 9, such as permanent magnet plates, and two angle brackets 8 which are secured to the narrow edge of the board 1 by screws 11 as best seen in FIG. 5. The angle brackets 8 are equipped with a protruding stud 12 engaging into an aperture in a flat surface 22 of the rail 6 for proper alignment. The studs 12 extend through the magnet plates 9 and into the aperture of the rail 6 so that the latter rests securely against the drafting board 1, yet in a manner which permits the easy removal of the rail 6 from the drafting board 1, or rather from the brackets 8.

Trammel heads 7 are slipped onto both ends of the rail 6. These trammel heads serve as end stops when the T-square is adjusted along the length of the rail 6 so that the runner 3 cannot be moved beyond the end stops formed by the trammel heads 7. The trammel heads 7 are clamped to the rail 6 by means of screws 15, one of which is provided for each trammel head. A guide cam 24 of each trammel head reaches into a longitudinal groove 13 of the rail 6. The trammel heads are so constructed that their surface 26 does not protrude beyond the surface 22 of the rail 6. Preferably, the two surfaces 22 and 26 are flush relative to each other.

If it is necessary to draw long lines on the drafting board 1, the rail 6 may be easily lifted off the angular brackets 8 and pulled out of the studs 12 so that the rail 6 may be placed with its supporting surface 22 flat in contact with the drafting board 1, or rather, on a sheet of drawing paper on the drafting board. Thus, the rail 6 may be used as a straight edge or ruler.

Figure 3:
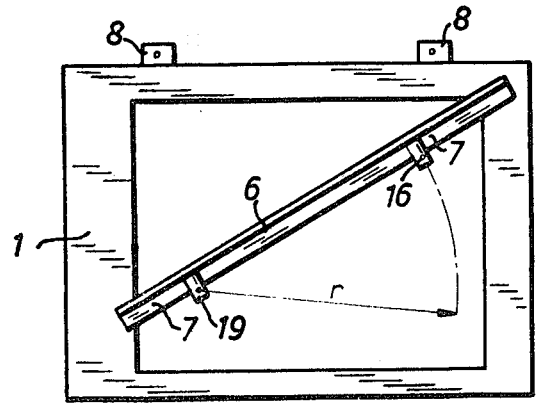
FIG. 3 is a top plan view onto the drawing board, whereby the guide rail is used as a beam compass.
Figure 4:
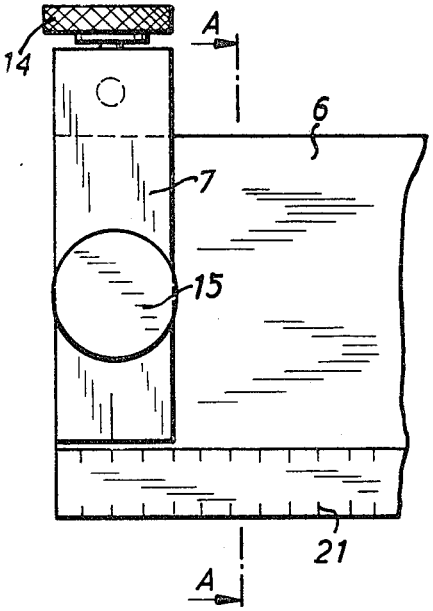
FIG. 4 is a detail top plan view showing the position of one of the trammel heads in which it operates as an end stop.

According to the invention the same rail 6 may be used as a beam compass when it is removed from the brackets 8, whereby the trammel heads 7 hold compass components 16, 19. For this purpose each trammel head 7 comprises a bore 25 for holding a pin-type compass insert 19 having a needle tip 20 or an insert 16 having a shaft 17 at one end and holding a drafting lead tip 18 in theother end. The shaft 17 and the insert 19 each fit into a respective bore 25 in which the respective insert is held by a hand screw 14. Thus, when the needle tip 20 is placed at a certain point on the drafting board 1 a relatively large circular arc may be drawn with this type of beam compass. FIG. 3 shows the relatively large radius "r" of such a circular arc. Arcs having such a large radius cannot be drawn with conventional drafting compass means.

Since the slanted surface 23 of the rail 6 is provided with a scale 21 or with a ruler, it is possible to accurately read the radius or to accurately adjust the radius by adjusting the relative positon of the trammel heads 7 along the rail 6. After the rail 6 has served its function as beam compass, it may again be placed in position along the longitudinal edge of the drafting board 1 to restore the condition illustrated in FIG. 1.

Although the invention has been described with reference to specific example embodiments, it will be appreciated, that it is intended to cover all modifications and equivalents within the scope of the appended claims.

What is claimed is:

1. A drafting apparatus for attachment to a drafting board, comprising rail means (6) having an upper edge (10) forming an abutment surface for a T-square, at least a portion of said rail means (6) being made of ferromagnetic material for magnetically holding a T-square, said rail means (6) further comprising a flat surface (22) for resting flat on a work surface, first means (8, 9, 12) for removably securing said rail means (6) to an edge of a drafting board, trammel head means (7), second means (13, 15, 24) for operatively securing said trammel head means to said rail means, and compass means (16, 19) operatively secured to said trammel head means, whereby said rail means are useable as a holding guide means for a T-square when the rail means are secured to a drafting board and as a straight edge or ruler or as a beam compass when the rail means are removed from a drafting board, and wherein said first means for removably securing said rail means comprise bracket means (8), means (11) for operatively securing said bracket means to an edge of a drafting board, and magnet means (9) operatively interposed between said bracket means and said rail means for removably holding said rail means to said bracket means.

2. The apparatus of claim 1, wherein said second securing means comprise a longitudinal groove (13) in said rail means for guiding said trammel head means when the trammel head means is sliding longitudinally along said rail means (6), said trammel head means comprising at least one further flat surface (26) located so as not to protrude beyond said first mentioned flat surface (22) of said rail means (6) when said trammel head means is secured to said rail means by the use of said groove (13).

3. The apparatus of claim 2, wherein said trammel head means comprise two trammel heads slidable back and forth along said rail means, said second securing means comprising arresting screw means for each trammel head, whereby these arresting screw means arrest the respective trammel head against said rail means, each trammel head comprising a bore extending perpendicularly to said further flat surface, said bore operatively receiving said compass means.

4. The apparatus of claim 2, wherein said trammel head means comprise a slide cam (26) movably held in said longitudinal groove of said rail means, said further flat surface of said trammel head means extending flush with said first mentioned flat surface of said rail means.

5. The apparatus of claim 1, wherein said rail means comprise, substantially opposite said first mentioned flat surface (22), a slanted surface (23) which includes with said first mentioned flat surface an acute angle, and scale means (21) on said slanted surface.

6. A drafting apparatus for attachment to a drafting board, comprising rail means (6) having an upper edge (10) forming an abutment surface for a T-square, said rail means (6) further comprising a flat surface (22) for resting flat on a work surface, first means (8, 9, 12) for removably securing said rail means (6) to an edge of a drafting board, trammel head means (7), second means (13, 15, 24) for operatively securing said trammel head means to said rail means, and compass means (16, 19) operatively secured to said trammel head means, whereby said rail means are useable as a holding guide means for a T-square when the rail means are secured to a drafting board and as a straight edge or ruler or as a beam compass when the rail means are removed from a drafting board, wherein said first means for removably securing said rail means comprise bracket means (8), means (11) for operatively securing said bracket means to an edge of a drafting board, and attachment means for removably holding said rail means to said bracket means, and wherein said second securing means comprise a guide cam (24) in said trammel head means (7) and a longitudinal groove (13) in said rail means (6) for guiding said trammel head means (7) when said guide cam (24) of the trammel head means is sliding longitudinally along said groove (13) of said rail means (6), said trammel head means comprising at least one further flat surface (26) located so as not to protrude beyond said first mentioned flat surface (22) of said rail means (6), when said trammel head means is secured to said rail means by the use of said groove (13).

* * * * *

UNITED STATES PATENT AND TRADEMARK OFFICE

CERTIFICATE OF CORRECTION

PATENT NO. : 4,343,094

DATED : August 10, 1982

INVENTOR(S) : Lorenzo Ubezio

It is certified that error appears in the above-identified patent and that said Letters Patent is hereby corrected as shown below:

The title page should be deleted to appear as per attached title page.

Signed and Sealed this

*Fourth* Day of *January 1983*

[SEAL]

*Attest:*

GERALD J. MOSSINGHOFF

*Attesting Officer*

*Commissioner of Patents and Trademarks*

United States Patent [19]

Ubezio

[11] 4,343,094

[45] Aug. 10, 1982

[54] DRAFTING APPARATUS

[75] Inventor: Lorenzo Ubezio, Dietikon, Switzerland

[73] Assignee: Reppisch-Werke AG, Dietikon, Switzerland

[21] Appl. No.: 135,541

[22] Filed: Mar. 31, 1980

[30] Foreign Application Priority Data

Apr. 3, 1979 [CH] Switzerland ..... 3076/79

[51] Int. Cl.[3] ..... B43L 13/04; B43L 7/00; B43L 9/04

[52] U.S. Cl. ..... 33/430; 33/27 C; 33/158; 33/483

[58] Field of Search ..... 33/27 C, 430, 158, DIG. 1, 33/479, 483

[56] References Cited

U.S. PATENT DOCUMENTS

| | | | |
|---|---|---|---|
| 685,369 | 10/1901 | Barrie | 33/479 |
| 1,014,803 | 1/1912 | Bohn | 33/27 C |
| 3,589,013 | 6/1971 | Colon | 33/27 C |
| 4,051,599 | 10/1977 | Sinkovec | 33/27 C |

FOREIGN PATENT DOCUMENTS

| | | |
|---|---|---|
| 1206363 | 2/1960 | France . |
| 163580 | 8/1933 | Switzerland . |

*Primary Examiner*—Charles E. Phillips
*Attorney, Agent, or Firm*—W. G. Fasse; D. F. Gould

[57] ABSTRACT

The present drafting apparatus comprises a rail (6) removably secured along the edge of a drafting board. Normally, the rail (6) serves for guiding a T-square (2, 3) which is, for example, pulled against the rail (6) by a magnetic force. If the rail (6) is released from the brackets (8) it may be used together with the trammel heads (7) as a beam compass. For this purpose one of the trammel heads (7) is equipped with a compass needle tip (19) and the other trammel head is equipped with a compass drafting lead tip holder (16). A scale (21) attached to the rail (6) permits the precise adjustment of the radius. Further, the rail (6) when removed from the brackets (8) may also be used as a straight edge for drawing long, straight lines.

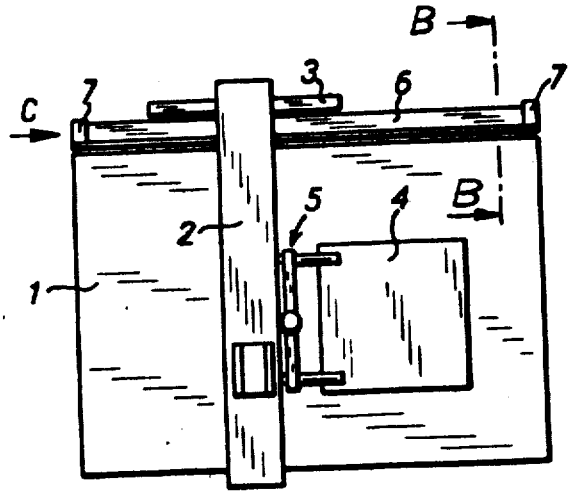

6 Claims, 7 Drawing Figures